US010408456B2

(12) United States Patent
Mulcaire

(10) Patent No.: US 10,408,456 B2
(45) Date of Patent: Sep. 10, 2019

(54) COMBUSTION CHAMBER ASSEMBLY

(71) Applicant: ROLLS-ROYCE plc, London (GB)

(72) Inventor: Thomas Gerard Mulcaire, Derby (GB)

(73) Assignee: ROLLS-ROYCE PLC, London (GB)

( * ) Notice: Subject to any disclaimer, the term of this patent is extended or adjusted under 35 U.S.C. 154(b) by 307 days.

(21) Appl. No.: 15/292,577

(22) Filed: Oct. 13, 2016

(65) Prior Publication Data

US 2017/0122565 A1 May 4, 2017

(30) Foreign Application Priority Data

Oct. 29, 2015 (GB) ..... 1519108.3

(51) Int. Cl.

| | |
|---|---|
| ***F23R 3/14*** | (2006.01) |
| ***F23R 3/28*** | (2006.01) |
| ***F23R 3/16*** | (2006.01) |
| ***F23R 3/10*** | (2006.01) |
| *F23D 11/10* | (2006.01) |

(52) U.S. Cl.

CPC ..... *F23R 3/28* (2013.01); *F23R 3/10* (2013.01); *F23R 3/16* (2013.01); *F23D 11/107* (2013.01); *F23R 3/14* (2013.01); *F23R 2900/00012* (2013.01)

(58) Field of Classification Search

CPC ..... F23R 3/10; F23R 3/16; F23R 3/28; F23R 3/283; F23R 2900/00012; F23R 3/14; F23R 3/286

See application file for complete search history.

(56) References Cited

U.S. PATENT DOCUMENTS 3,458,997 A * 8/1969 Clark ..... F23R 3/283 431/189
3,677,474 A * 7/1972 Lorenzen ..... B05B 15/654 239/587.4
3,684,186 A * 8/1972 Helmrich ..... F23D 11/107 239/400

(Continued)

FOREIGN PATENT DOCUMENTS

WO 96/018850 A1 6/1996
WO 96/018852 A1 6/1996

OTHER PUBLICATIONS

Apr. 26, 2016 Search Report issued in British Patent Application No. 1519108.3.

*Primary Examiner* — Todd E Manahan
*Assistant Examiner* — Eric W Linderman
(74) *Attorney, Agent, or Firm* — Oliff PLC

(57) ABSTRACT

A combustion chamber assembly includes a combustion chamber casing, a combustion chamber, a plurality of fuel injectors and respective seals. The axis of each fuel injector head is arranged at an angle to the axis of the combustion chamber casing and parallel to the center line of the combustion chamber. Each seal is positioned between a fuel injector head and an aperture in an upstream wall of the combustion chamber. Each seal has an aperture extending through the seal which is arranged parallel to the axis of the combustion chamber casing or the flange of the fuel injector. Each fuel injector head has a part spherical surface located in a seal. The assembly provides a clearance required to engage, or disengage, a fuel injector head while minimizing the amount of material removed from the between the apertures in the upstream wall of the combustion chamber.

20 Claims, 3 Drawing Sheets

(56) References Cited

U.S. PATENT DOCUMENTS 3,980,233 A * 9/1976 Simmons ..... F23D 11/107 239/400
4,441,323 A 4/1984 Colley
4,454,711 A * 6/1984 Ben-Porat ..... F23R 3/10 60/748
4,463,568 A * 8/1984 Willis ..... F23D 17/002 60/742
4,600,151 A * 7/1986 Bradley ..... F23D 11/107 239/400
4,618,173 A * 10/1986 Dopyera ..... F16L 27/053 285/261
4,693,074 A 9/1987 Pidcock et al.
4,754,922 A * 7/1988 Halvorsen ..... B05B 7/065 137/513.5
4,773,596 A * 9/1988 Wright ..... F23C 7/004 239/400
4,831,700 A * 5/1989 Halvorsen ..... B05B 7/065 29/888.01
4,854,127 A * 8/1989 Vinson ..... F23C 7/002 60/742
4,914,918 A * 4/1990 Sullivan ..... F23D 11/36 60/756
4,934,145 A * 6/1990 Zeisser ..... F23R 3/002 60/740
4,938,417 A * 7/1990 Halvorsen ..... B05B 7/065 123/531
4,962,889 A * 10/1990 Halvorsen ..... B05B 7/065 123/531
4,999,996 A * 3/1991 Duchene ..... F23R 3/283 60/740
5,044,559 A * 9/1991 Russell ..... F23D 11/107 239/406
5,102,054 A * 4/1992 Halvorsen ..... B05B 7/065 123/531
5,172,545 A * 12/1992 Forestier ..... F23R 3/283 29/8
5,174,504 A * 12/1992 Halvorsen ..... B05B 7/065 137/855
5,197,290 A * 3/1993 Lee ..... F23R 3/14 137/855
5,207,064 A * 5/1993 Ciokajlo ..... F23R 3/16 60/737
5,222,358 A * 6/1993 Chaput ..... F23R 3/283 60/740
5,365,738 A * 11/1994 Etheridge ..... F23C 7/008 239/126
5,419,115 A * 5/1995 Butler ..... F23R 3/10 60/740
5,505,045 A * 4/1996 Lee ..... F23D 11/107 239/424
5,542,246 A * 8/1996 Johnson ..... F23R 3/10 60/755
5,577,379 A * 11/1996 Johnson ..... F23R 3/10 60/740
5,581,999 A * 12/1996 Johnson ..... F23R 3/10 60/756
5,761,907 A * 6/1998 Pelletier ..... F23D 11/107 239/397.5
5,894,732 A * 4/1999 Kwan ..... F23R 3/283 60/748
5,916,142 A * 6/1999 Snyder ..... F23C 7/004 60/740
5,956,955 A * 9/1999 Schmid ..... F23R 3/283 60/748
5,996,335 A * 12/1999 Ebel ..... F23R 3/50 60/740
6,035,645 A * 3/2000 Bensaadi ..... F23R 3/14 60/742
6,082,113 A * 7/2000 Prociw ..... F23C 7/002 60/748
6,158,781 A * 12/2000 Aaron, III ..... F16L 27/053 285/23
6,272,840 B1 * 8/2001 Crocker ..... F02C 7/22 239/404
6,679,063 B2 * 1/2004 Ebel ..... F23R 3/10 60/747
7,223,019 B2 * 5/2007 Hoppe ..... F04B 1/2071 384/192
7,356,994 B2 * 4/2008 Bleeker ..... F23C 5/02 60/740
7,628,019 B2 12/2009 Tanner et al.
7,775,051 B2 * 8/2010 Hernandez ..... F23R 3/60 60/748
7,779,636 B2 * 8/2010 Buelow ..... F23R 3/14 60/742
7,827,795 B2 * 11/2010 Hicks ..... F02C 3/30 60/39.83
7,992,391 B2 * 8/2011 Caboche ..... F23R 3/10 60/755
8,348,180 B2 * 1/2013 Mao ..... F23D 11/107 239/403
8,453,459 B2 * 6/2013 Cameriano ..... F23R 3/283 60/39.11
8,701,417 B2 * 4/2014 Nicholls ..... F23R 3/10 60/756
9,097,425 B2 * 8/2015 Hernandez ..... F23R 3/14
9,310,083 B2 * 4/2016 Bunel ..... F23R 3/14
9,500,371 B2 * 11/2016 Bunel ..... F23R 3/14
9,664,391 B2 * 5/2017 Kobayashi ..... F23R 3/14
9,765,970 B2 * 9/2017 Bourgois ..... F23R 3/06
9,920,693 B2 * 3/2018 Hanson ..... F23R 3/14
9,927,126 B2 * 3/2018 Benjamin ..... F23R 3/343
10,174,946 B2 * 1/2019 Cunha ..... F23R 3/002
2006/0207258 A1 * 9/2006 Tanner ..... F23C 5/02 60/748
2007/0033950 A1 * 2/2007 Bernier ..... F23R 3/14 60/796
2007/0084215 A1 * 4/2007 Hernandez ..... F23R 3/10 60/796
2007/0137218 A1 * 6/2007 Prociw ..... F23R 3/283 60/796
2007/0289305 A1 * 12/2007 Oda ..... F23D 11/383 60/748
2008/0000447 A1 * 1/2008 Locatelli ..... F23R 3/14 123/306
2008/0202122 A1 * 8/2008 Guezengar ..... F23R 3/002 60/722
2009/0173076 A1 * 7/2009 Toon ..... F23D 14/74 60/746
2010/0050644 A1 * 3/2010 Pidcock ..... F23D 11/107 60/737
2010/0058765 A1 * 3/2010 Duval ..... F23R 3/283 60/740
2010/0269506 A1 * 10/2010 Nonaka ..... F23D 11/386 60/742
2011/0000216 A1 * 1/2011 Imamura ..... F23R 3/60 60/748
2011/0067403 A1 * 3/2011 Williams ..... F23R 3/343 60/742
2011/0088409 A1 * 4/2011 Carlisle ..... F23R 3/283 60/796
2011/0113789 A1 * 5/2011 Duval ..... F23R 3/283 60/796
2012/0240595 A1 * 9/2012 Gerendas ..... F23R 3/002 60/796
2013/0199194 A1 * 8/2013 Carlisle ..... F23R 3/002 60/772
2013/0283803 A1 * 10/2013 Bunel ..... F23R 3/14 60/737
2014/0116066 A1 * 5/2014 Melton ..... F23R 3/28 60/806
2014/0216040 A1 * 8/2014 Johnson ..... F23R 3/283 60/737
2015/0159874 A1 * 6/2015 Toon ..... F23R 3/283 60/737
2016/0033130 A1 * 2/2016 Low ..... F23R 3/283 60/740
2016/0209037 A1 * 7/2016 Dai ..... F23R 3/14

(56) References Cited

U.S. PATENT DOCUMENTS

| | | | | |
|---|---|---|---|---|
| 2017/0067638 | A1* | 3/2017 | Le Pannerer | F23R 3/14 |
| 2017/0248320 | A1* | 8/2017 | Hannwacker | F23R 3/14 |
| 2017/0276356 | A1* | 9/2017 | Mulcaire | F23R 3/002 |
| 2017/0299192 | A1* | 10/2017 | Lunel | F23R 3/283 |
| 2017/0363290 | A1* | 12/2017 | Mery | F23R 3/10 |
| 2018/0003385 | A1* | 1/2018 | Rodrigues | F23R 3/283 |
| 2018/0073736 | A1* | 3/2018 | Papple | F23R 3/10 |
| 2018/0106481 | A1* | 4/2018 | Aurifeille | F23R 3/60 |
| 2018/0313542 | A1* | 11/2018 | Leparoux | F23R 3/14 |

* cited by examiner

COMBUSTION CHAMBER ASSEMBLY

The present disclosure concerns a combustion chamber assembly and in particular to a combustion chamber assembly for a gas turbine engine.

A typical combustion chamber assembly comprises an annular combustion chamber casing, an annular combustion chamber, a plurality of fuel injectors and a plurality of tubular seals. The annular combustion chamber casing has a plurality of apertures extending there-through. The annular combustion chamber comprises an annular upstream end wall which has a plurality of apertures extending there-through. Each fuel injector comprises a fuel feed arm, a flange and a fuel injector head and each fuel injector locates in a respective one of the apertures in the annular combustion chamber casing. The flange of each fuel injector is secured to the annular combustion chamber casing. The fuel injector head of each fuel injector is located in a respective one of the apertures in the upstream end wall of the annular combustion chamber. Each tubular seal is positioned between an associated fuel injector head and the corresponding aperture in the upstream end wall of the annular combustion chamber. Each tubular seal has a flange and an aperture which extends through the tubular seal and the tubular seal is arranged generally coaxially with the axis of the corresponding aperture in the upstream end wall of the annular combustion chamber. Each tubular seal is movable radially with respect to the axis of the associated aperture in the upstream end wall of the annular combustion chamber casing. Each fuel injector head is located in the associated tubular seal and the fuel injector head abuts the associated tubular seal.

Thus, the fuel injector heads of the fuel injectors are sealed to the annular combustion chamber by the tubular seals. In operation the annular combustion chamber heats up more rapidly than the annular combustion chamber casing and thus they expand at different rates. The tubular seals are able to move relative to the annular combustion chamber to accommodate the differential radial thermal expansion of the annular combustion casing and the annular combustion chamber while providing seals around the fuel injector heads. The tubular seals are able to move relative to the annular combustion chamber to accommodate axial expansion of the annular combustion chamber through the tubular seals sliding relative to the fuel injector heads of the fuel injectors.

The fuel injectors are installed and removed from the annular combustion chamber using the apertures extending through the annular combustion chamber casing. The apertures in the annular combustion chamber casing are designed to have a suitable diameter to allow each fuel injector to be moved generally axially away from the upstream end wall of the annular combustion chamber to enable the fuel injector head of the fuel injector to disengage from the respective tubular seal, e.g. move axially with respect to the tubular seal and out of the tubular seal, and to allow each fuel injector to be moved generally axially towards the upstream end wall of the annular combustion chamber to enable the fuel injector head of the fuel injector to engage the respective tubular seal, e.g. move axially with respect to the tubular seal and into the tubular seal. The apertures in the annular combustion chamber are therefore generally larger in diameter than that required for purely relative thermal expansion of the annular combustion chamber relative to the fuel injectors.

The above arrangement is adequate for conventional rich burn fuel injectors which comprise fuel injector heads with a relatively small outside diameter and relatively small axial length.

However, lean burn fuel injectors comprise fuel injector heads with a larger outside diameter and a longer axial length than the fuel injector heads of rich burn fuel injectors and have to be moved a larger axial distance before the fuel injector heads can be disengaged from, or engaged with, the associated tubular seals. Furthermore, additional radial clearance has to be provided between the tubular seals and the upstream end wall of the combustion chamber to allow the axial movement of the lean burn fuel injectors. Additionally, if the outlet of the high pressure compressor and the inlet of the turbine are at different radii it is necessary to angle the combustion chamber with respect to the axis of the gas turbine engine. The requirement to fit lean burn fuel injectors, the requirement to provide an angled combustion chamber and the requirement for increased radial clearances results in an increase in the diameters of the apertures in the upstream end wall of the annular combustion chamber. The increased diameters of the apertures in the upstream end wall of the annular combustion chamber reduces the distances, and amount of material, between these apertures which reduces the strength of the upstream end wall and reduces the space available to provide cooling holes in the upstream end wall.

Accordingly, the present disclosure seeks to provide a combustion chamber assembly which reduces, or overcomes, the above mentioned problem.

According to a first aspect of the present disclosure there is provided a combustion chamber assembly comprising an annular combustion chamber casing, at least one combustion chamber, at least one fuel injector and at least one tubular seal, the combustion chamber casing having an axis and at least one aperture extending there-through, the combustion chamber having a centre line, the combustion chamber comprising an upstream end wall having at least one aperture extending there-through, the centre line of the combustion chamber being arranged at an angle to the axis of the annular combustion chamber casing, the at least one fuel injector comprising a fuel feed arm, a flange and a fuel injector head, the at least one fuel injector locating in the at least one aperture in the annular combustion chamber casing, the flange of the at least one fuel injector being secured to the annular combustion chamber casing, the fuel injector head of the at least one fuel injector being located in the at least one aperture in the upstream end wall, the fuel injector head having an axis and a plurality of annular passages, the axis of the fuel injector head being arranged at an angle to the axis of the annular combustion chamber casing and/or at an angle to the flange of the fuel injector and parallel to the centre line of the at least one combustion chamber, the at least one tubular seal being positioned between the fuel injector head and the at least one aperture in the upstream end wall, the at least one tubular seal having a flange, an aperture extending through the at least one tubular seal and the axis of the aperture being arranged parallel to the axis of the annular combustion chamber casing and/or parallel to the flange of the fuel injector, the at least one tubular seal being movable radially and circumferentially with respect to the axis of the annular combustion chamber casing, the fuel injector head being located in the at least one tubular seal, the fuel injector head having a part spherical surface and the part spherical surface of the fuel injector head abutting the at least one tubular seal.

The at least one combustion chamber may comprise at least one heat shield, the at least one heat shield being adjacent to and spaced from a first surface of the upstream end wall of the at least one combustion chamber, the at least one heat shield having an aperture extending there-through, the aperture in the at least one heat shield being arranged coaxial with the at least one aperture in the upstream end wall of the combustion chamber.

The at least one combustion chamber may comprise at least one tubular location ring, the at least one tubular location ring being arranged between the at least one tubular seal and the at least one aperture in the upstream end wall, the at least one tubular location ring having an aperture extending there-through, the aperture in the at least one tubular location ring being arranged coaxial with the at least on aperture in the upstream end wall of the combustion chamber.

The at least one tubular location ring being positioned in and extending through the at least one aperture in the upstream end wall of the at least one combustion chamber, a first end of the at least one tubular location ring locating in the aperture in the at least one heat shield to secure the at least one heat shield on the upstream end wall of the at least one combustion chamber.

A second end of the at least one tubular location ring having a flange arranged to abut a second surface of the upstream end wall of the combustion chamber.

The axis of the at least one aperture in the upstream end wall of the combustion chamber may be arranged parallel to the centre line of the at least one combustion chamber.

The axis of the at least one aperture in the upstream end wall of the combustion chamber may be arranged parallel to the axis of the annular combustion chamber casing and/or parallel to the flange of the fuel injector.

The axis of the aperture through the tubular seal may be arranged at an angle to the axis of the tubular seal. The axis of the tubular seal may be arranged parallel to the centre line of the at least one combustion chamber. The flange of the tubular seal may be arranged perpendicular to the axis of the tubular seal.

The axis of the aperture through the tubular seal may be arranged coaxial with the axis of the tubular seal. The axis of the tubular seal may be arranged parallel to the axis of the annular combustion chamber casing and/or parallel to the flange of the fuel injector. The flange of the tubular seal may be arranged at an angle to the axis of the tubular seal.

The combustion chamber casing may have a plurality of apertures extending there-through, the at least one combustion chamber comprising an annular combustion chamber, a plurality of fuel injectors and a plurality of tubular seals, the upstream end wall having a plurality of apertures extending there-through, the flange of each fuel injector being secured to the annular combustion chamber casing, the fuel injector head of each fuel injector being located in a respective one of the apertures in the upstream end wall, each tubular seal being positioned between one of the fuel injector heads and the respective aperture in the upstream end wall, the aperture through each tubular seal being arranged parallel to the axis of the annular combustion chamber casing and/or parallel to the flange of the fuel injector, each fuel injector head being located in the respective tubular seal, each fuel injector head having a part spherical surface and the part spherical surface of each fuel injector head abutting the respective tubular seal.

The at least one fuel injector may be a lean burn fuel injector or a rich burn fuel injector.

The lean burn fuel injector may comprise a first inner air passage, a first annular fuel passage, a second annular air passage, a third annular air passage, second annular fuel passage and a fourth annular passage. The lean burn fuel injector may comprise a fifth annular air passage between the second annular air passage and the third annular air passage. Each of the air passages may comprise a plurality of swirl vanes. Each of the annular fuel passages may direct the fuel onto a pre-filming surface.

The rich burn fuel injector may comprise a first inner air passage, a first annular fuel passage, a second annular air passage and a third annular air passage. The rich burn fuel injector may comprise a first inner air passage, a second annular air passage, a first annular fuel passage and a third annular air passage. Each of the air passages may comprise a plurality of swirl vanes. The annular fuel passage may direct the fuel onto a pre-filming surface.

The part spherical surface of the fuel injector head may comprise a ring arranged coaxial with the axis of the fuel injector head. The part spherical surface of the fuel injector head may comprise an ellipse arranged in a plane at an angle to the axis of the fuel injector head. The contact points between the part spherical surface of the fuel injector head and the tubular seal may be arranged axis-symmetrically with respect to the fuel injector head. The contact points between the part spherical surface of the fuel injector head and the tubular seal may be arranged helically, or part helically, with respect to the axis of the fuel injector head.

The flange of the fuel injector may not be arranged at a perpendicular angle to the fuel feed arm and the fuel feed arm being arranged at a perpendicular angle to the axis of the fuel injector head. The flange of the fuel injector may not be arranged at a perpendicular angle to the fuel feed arm and the fuel feed arm not being arranged at a perpendicular angle to the axis of the fuel injector head. The flange of the fuel injector may be arranged at a perpendicular angle to the fuel feed arm and the fuel feed arm not being arranged at a perpendicular angle to the axis of the fuel injector head.

According to a second aspect of the present disclosure there is provided a combustion chamber assembly comprising an annular combustion chamber casing, at least one combustion chamber, at least one fuel injector and at least one tubular seal, the combustion chamber casing having an axis and at least one aperture extending there-through, the combustion chamber comprising an upstream end wall having at least one aperture extending there-through, the at least one fuel injector comprising a fuel feed arm, a flange and a fuel injector head, the at least one fuel injector locating in the at least one aperture in the annular combustion chamber casing, the flange of the at least one fuel injector being secured to the annular combustion chamber casing, the fuel injector head of the at least one fuel injector being located in the at least one aperture in the upstream end wall, the fuel injector head having an axis and a plurality of annular passages, the axis of the fuel injector head being arranged at an angle to the axis of the annular combustion chamber casing and/or at an angle to the flange of the fuel injector, the at least one tubular seal being positioned between the fuel injector head and the at least one aperture in the upstream end wall, the at least one tubular seal having a flange, an aperture extending through the at least one tubular seal and the axis of the aperture being arranged parallel to the axis of the annular combustion chamber casing and/or parallel to the flange of the fuel injector, the at least one tubular seal being movable radially and circumferentially with respect to the axis of the annular combustion chamber casing, the fuel injector head being located in the at least one tubular seal, the fuel injector head having a part spherical surface and the part spherical surface of the fuel injector head abutting the at least one tubular seal.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which:—

Figure 1:
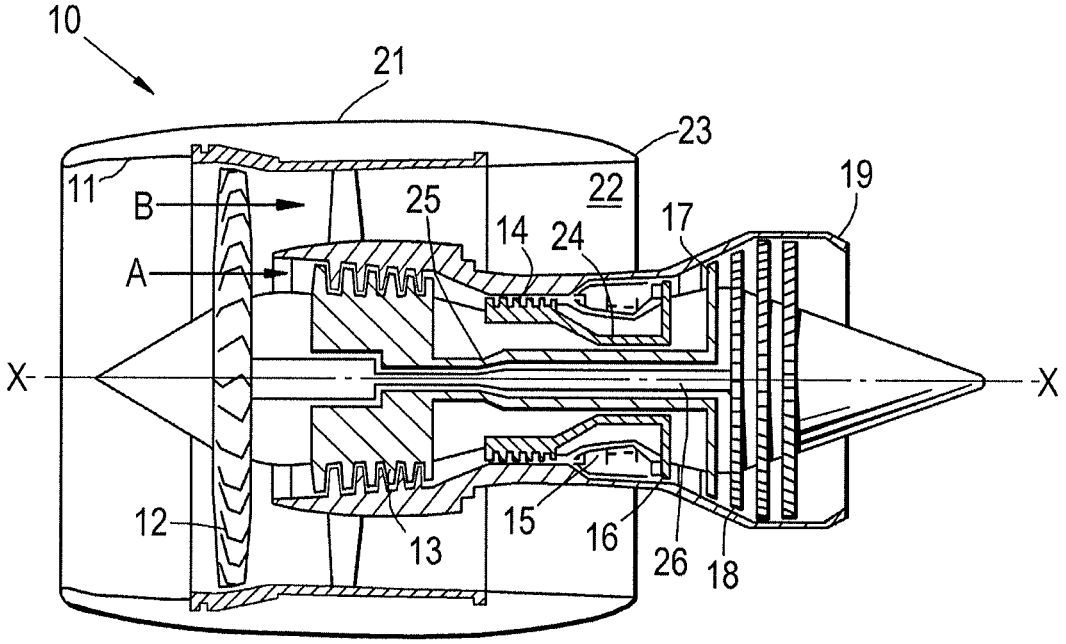
FIG. 1 is a sectional side view of a turbofan gas turbine engine.

With reference to FIG. 1, a turbofan gas turbine engine is generally indicated at 10, having a principal and rotational axis X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A nacelle 21 generally surrounds the engine 10 and defines the intake 11, a bypass duct 22 and a bypass exhaust nozzle 23.

The gas turbine engine 10 works in the conventional manner so that air entering the intake 11 is compressed by the fan 12 to produce two air flows: a first air flow A into the intermediate pressure compressor 13 and a second air flow B which passes through a bypass duct 22 to provide propulsive thrust. The intermediate pressure compressor 13 compresses the air flow directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, intermediate pressure compressor 13 and fan 12, each by suitable interconnecting shaft 24, 25 and 26 respectively.

Figure 2:
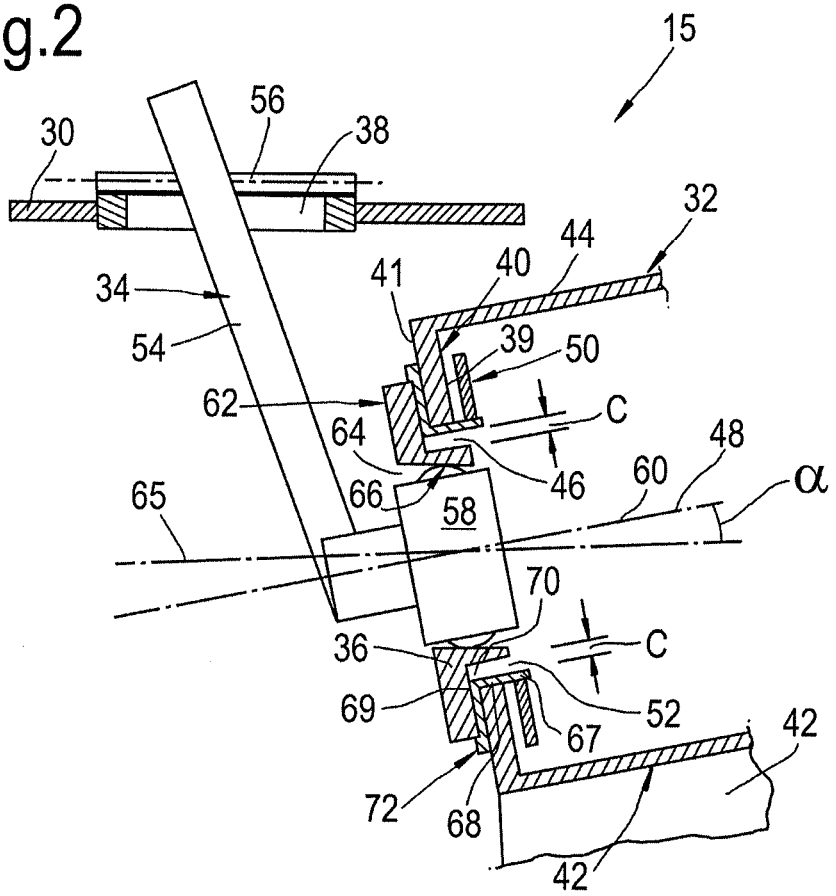
FIG. 2 is an enlarged schematic cross-sectional view of the combustion chamber assembly shown in FIG. 1.

The combustion chamber assembly 15 is shown more clearly in FIG. 2 and the combustion chamber assembly 15 comprises an annular combustion chamber casing 30, an annular combustion chamber 32, a plurality of fuel injectors 34 and a plurality of tubular seals 36.

The annular combustion chamber casing 30 has an axis which is coaxial with the rotational axis X of the gas turbine engine 10 and the annular combustion chamber casing 30 has a plurality of apertures 38 extending there-through. The apertures 38 extend radially through the annular combustion chamber casing 30 and the apertures 38 are circumferentially spaced apart and are arranged in a common plane perpendicular to the axis of the annular combustion chamber casing 30. The apertures 38 are generally equally spaced circumferentially around the annular combustion chamber casing 30.

The annular combustion chamber 32 comprises an upstream end wall 40, a radially inner annular wall 42 and a radially outer annular wall 44. The upstream end of the radially inner annular wall 42 is secured to the upstream end wall 40 and the upstream end of the radially outer annular wall 44 is secured to the upstream end wall 40. The upstream end wall 40 is also known as a metering panel or metering wall. The upstream end wall 40 has a plurality of apertures 46 extending there-through. The apertures 46 extend perpendicularly through the upstream end wall 40 of the annular combustion chamber 32 and the apertures 46 are circumferentially spaced apart. The apertures 46 are generally equally spaced circumferentially around the upstream end wall 40 of the annular combustion chamber casing 32. The annular combustion chamber 32 and the centre line 48 of the combustion chamber 32 are arranged at an acute angle $\alpha$ to the axis of the annular combustion chamber casing 30 and the axis X of the turbofan gas turbine engine 10. Thus, it can be see that the upstream end wall 40 is frusto-conical, e.g. the upstream end wall 40 is arranged on a part conical surface.

The annular combustion chamber 32 also comprises a plurality of heat shields 50 on the upstream end wall 40 within the annular combustion chamber 32 to protect the upstream end wall 40 from the hot combustion gases. The heat shields 50 are circumferentially arranged side by side on the upstream end wall 40 and each heat shield 50 has a central aperture 52 extending there-through which is aligned with, e.g. arranged coaxially with, a respective one of the apertures 46 in the upstream end wall 40. The heat shields 50 are adjacent to and spaced from a first surface 39 of the upstream end wall 40 of the annular combustion chamber 32. Each heat shield 50 is secured to the upstream end wall 40 by a plurality of threaded studs (not shown) which extend from the heat shield 50 through apertures (not shown) in the upstream end wall 40 and nuts (not shown). However, the heat shields 50 may be secured to the upstream end wall 40 by other suitable arrangements. Each heat shield 50 has walls (not shown) extending from its radial and circumferentially extending edges to space the heat shield 50 from the first surface 39 of the upstream end wall 40 and to form a chamber between the heat shield 50 and the upstream end wall 40. The upstream end wall 40 has impingement cooling holes (not shown) extending there-through to supply coolant, e.g. air, into the chambers between the heat shields 50 and the upstream end wall 40 and the heat shields 50 have effusion cooling holes (not shown) to provide a film of coolant, e.g. air, over the hot surface of the heat shields 50.

The radially inner annular wall 42 may be provided with a plurality of circumferentially and axially spaced tiles (not shown) spaced radially outwardly from the radially inner annular wall 42 at a greater radial distance to protect the radially inner annular wall 42 from the hot combustion gases. Similarly, the radially outer annular wall 44 may be provided with a plurality of circumferentially and axially spaced tiles (not shown) spaced radially inwardly from the radially outer annular wall 44 at a smaller radial distance to protect the radially outer annular wall 44 from the hot combustion gases. Each tile is secured to the respective annular wall 42 or 44 by a plurality of threaded studs (not shown) which extend from the tile through apertures in the respective annular wall 42 or 44 and nuts (not shown). However, the heat shields may be secured to the annular walls 42 and 44 by other suitable arrangements.

Each fuel injector 34 comprises a fuel feed arm 54, a flange 56 and a fuel injector head 58. Each fuel injector 34 locates in a corresponding one of the apertures 38 in the annular combustion chamber casing 30 and the flange 56 of each fuel injector 34 is secured to the annular combustion chamber casing 30. The flange 56 of each fuel injector 34 is secured to a respective boss on the outside of the annular combustion chamber casing 30 by a plurality of bolts (not shown) which locate in threaded holes in the boss.

The fuel injector head 58 of each fuel injector 34 is located in a corresponding one of the apertures 46 in the upstream end wall 40. The fuel injector head 58 of each fuel injector 34 has an axis 60 and a plurality of coaxial passages (not shown). The axis 60 of the fuel injector head 58 is arranged at the acute angle α to the axis of the annular combustion chamber casing 30 and the axis X of the turbofan gas turbine engine 10 and is parallel to the centre line 48 of the annular combustion chamber 32.

Each tubular seal 36 is positioned between the associated fuel injector head 58 and the corresponding aperture 46 in the upstream end wall 40 of the annular combustion chamber 32. Each tubular seal 36 comprises a flange 62 and an aperture 64 extending through the tubular seal 36 and the axis 65 of the aperture 64 is arranged parallel to the axis of the annular combustion chamber casing 30 and to the axis X of the turbofan gas turbine engine 10. Each tubular seal 36 is movable radially and circumferentially with respect to the axis of the annular combustion chamber casing 30. Each tubular seal 36 is also movable radially with respect to the axis of the corresponding aperture 46 in the upstream end wall 40 of the annular combustion chamber 32.

Each fuel injector head 58 is located in the corresponding tubular seal 36 and each fuel injector head 58 has a part spherical surface 66 and the part spherical surface 66 of each fuel injector head 58 abuts the corresponding tubular seal 36. The contact between the part spherical surface 66 of each fuel injector head 58 and the corresponding tubular seal 36 forms an air seal.

The annular combustion chamber 32 also comprises a plurality of tubular location rings 68 and each tubular location ring 68 is arranged between a respective one of the tubular seals 36 and the associated aperture 46 in the upstream end wall 40. Each tubular location ring 68 has an aperture 70 extending there-through and the aperture 70 in each tubular location ring 68 is aligned with, arranged coaxially, with the aperture 46 in the upstream end wall 40 of the annular combustion chamber 32.

Each tubular location ring 68 is positioned in and extends through a corresponding one of the apertures 46 in the upstream end wall 40 of the annular combustion chamber 32. A first end 67 of each tubular location ring 68 is located in the aperture 52 in an associated heat shield 50 in close fitting relationship with the heat shield 50 to form a seal to the hot gases in the annular combustion chamber 32. A second end 69 of each tubular location ring 68 has a flange 72 arranged to abut a second surface 41 of the upstream end wall 40 of the annular combustion chamber 32.

In the arrangement shown in FIG. 2, the axis of each aperture 46 in the upstream end wall 40 of the annular combustion chamber 32 is arranged parallel to the centre line 48 of the annular combustion chamber 32, e.g. is arranged at the acute angle α to the axis of the annular combustion chamber casing 30 and the axis X of the turbofan gas turbine engine 10. The axis 65 of the aperture 64 through each tubular seal 36 is arranged at an angle to the axis of the respective tubular seal 36. The axis 65 is also arranged parallel to the flange 56 of the fuel injector 34. The axis of each tubular seal 36 is arranged parallel to the centre line of the annular combustion chamber 32 and hence is arranged at the acute angle α to the axis of the annular combustion chamber casing 30 and the axis X of the turbofan gas turbine engine 10. The flange 62 of each tubular seal 36 is arranged perpendicular to the axis of the tubular seal 36. The part spherical surface 66 of each fuel injector head 58 comprises a ring arranged coaxial with the axis 60 of the fuel injector head 58. Thus, it is to be noted that the flange 56 of each fuel injector 34 is not parallel with the axis 60 of the fuel injector head 58.

The apertures 46 in the upstream end wall 40, the apertures 70 in the location ring 68, the apertures 52 in the heat shields 50 and the apertures 64 in the tubular seal 36 are all circular in cross-section. It is to be noted that there is a radial clearance C between the outer diameter of the tubular seal 36 and the inner diameter of the associated location ring 68.

Each location ring 68 is secured, e.g. bolted, to the upstream end wall 40 of the annular combustion chamber 32. Each tubular seal 36 is trapped by a respective retaining plate, or a washer, (not shown) which is secured, e.g. bolted, to the upstream end wall 40 of the annular combustion chamber 32. Each retaining plate, or washer, may be secured to the upstream end wall 40 of the annular combustion chamber 32 using the same bolts that are used to secure a respective one of the location rings 68. Each retaining plate, or washer, is arranged to be clear by a small radial distance from the flange 62 of the associated tubular seal 36 to allow free radial movement of the tubular seal 36 whilst also allowing a small amount of axial movement of the tubular seal 36.

To disengage and remove a fuel injector 34 from the annular combustion chamber 32, the flange 56 of the fuel injector 34 is unfastened from the annular combustion chamber casing 30 by unfastening the bolts threaded into the boss of the annular combustion chamber casing 30. The fuel injector 34 is manipulated to move, e.g. slide, the fuel injector head 58 generally axially parallel to the axis of the combustion chamber casing 30 in an upstream direction, to the left in FIG. 2, out of the tubular seal 36 and away from the annular combustion chamber 32. The fuel injector 34 may be manipulated by maintaining the flange 56 of the fuel injector 34 generally parallel with the axis of the annular combustion chamber casing 30. The arrangement of the axis 65 of the aperture 64 through the tubular seal 36 enables the fuel injector head 58 to be easily removed from the tubular seal 36 without the requirement for extra radial clearance for the tubular seal 36 to move radially to enable the fuel injector head 58 to move axially as described for the previous arrangement. Once the fuel injector head 58 has been removed from the tubular seal 36 the fuel injector 34 and fuel injector head 58 may be withdrawn radially outwardly through the aperture 38 in the annular combustion chamber casing 30. To engage and install a fuel injector 34 from the annular combustion chamber 32 the opposite procedure is used.

Figure 3:
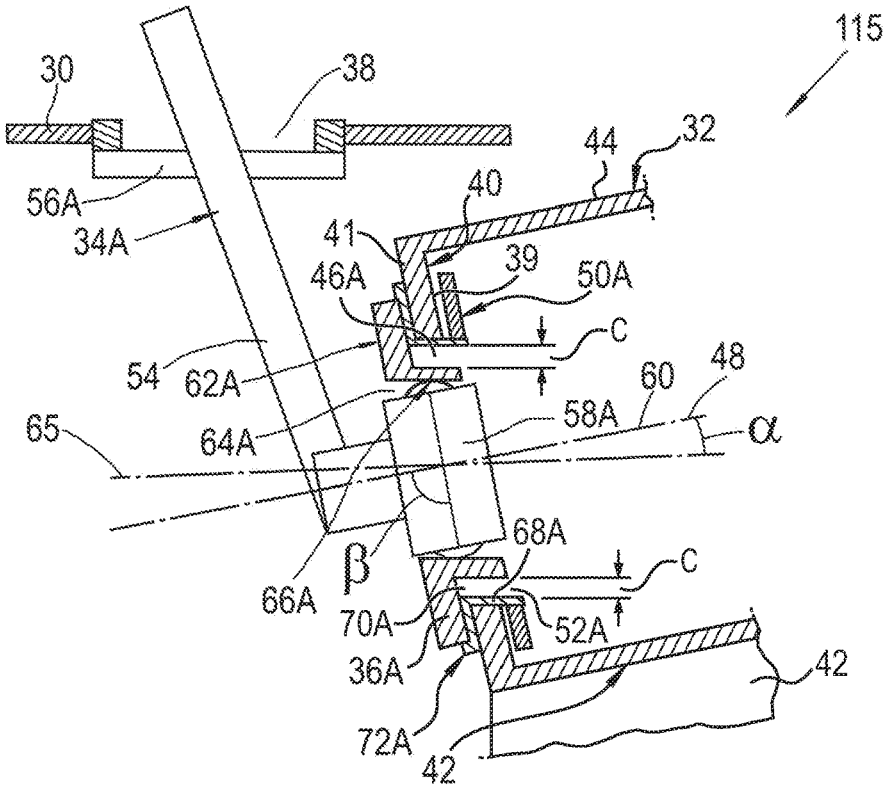
FIG. 3 is an enlarged alternative schematic cross-sectional view of the combustion chamber assembly shown in FIG. 1.

An alternative combustion chamber assembly 115 is shown in FIG. 3. The combustion chamber assembly 115 is substantially the same as the combustion chamber assembly 15 shown in FIG. 2 and like parts are denoted by like numerals. The arrangement of FIG. 3 differs from that of FIG. 2 in that the axis of each aperture 46A in the upstream end wall 40 of the annular combustion chamber 32 is arranged parallel to the axis of the annular combustion chamber casing 30 and hence parallel to the axis X of the turbofan gas turbine engine 10. The axis of the aperture 64A through each tubular seal 36A is arranged coaxial with the axis of the tubular seal 36A. The axis 65 of each tubular seal 36A is arranged parallel to the axis of the annular combustion chamber casing 30 and the axis X of the turbofan gas turbine engine 10. The flange 62 of each tubular seal 36A is arranged at an angle to the axis of the tubular seal 36A. The part spherical surface 66A of each fuel injector head 58A comprises an ellipse arranged in a plane at an angle β to the axis 60A of the fuel injector head 58A. The arrangement of the spherical surface 66A of each fuel injector head 58A in FIG. 3 ensures that the contact points between the spherical surface 66A and the internal surface of the tubular seal 36A are axially within the tubular seal 36A at all extremes of tolerance and for all relative axial movements between the fuel injector head 58A and the tubular seal 36A. It is to be noted that the angle β is generally parallel to the angle of the frustoconical upstream end wall 40. In addition the flange 56A of each fuel injector 34A is secured to the inside of the annular combustion chamber casing 30. Similarly, the axis of the aperture 52A in each heat shield 50A is arranged parallel to the axis of the annular combustion chamber casing 30 and hence parallel to the axis X of the turbofan gas turbine engine 10. The axis of the aperture 70A through each tubular location ring 68A is arranged coaxial with the axis of the tubular location ring 68A. The axis 70A of each tubular location ring 68A is arranged parallel to the axis of the annular combustion chamber casing 30 and the axis X of the turbofan gas turbine engine 10. The flange 72A of each tubular location ring 68A is arranged at an angle to the axis of the tubular location ring 68A. The flange 56A of each fuel injector 34A is secured to a respective boss on the inside of the annular combustion chamber casing 30 by a plurality of bolts (not shown) which locate in threaded holes in the boss.

In all of the arrangements the heat shields 50, the tiles, the tubular location rings 68 and the tubular seals 36 are manufactured from nickel superalloy which has a greater temperature and corrosion resistance than the nickel superalloy of the upstream end wall 40.

Figure 4:
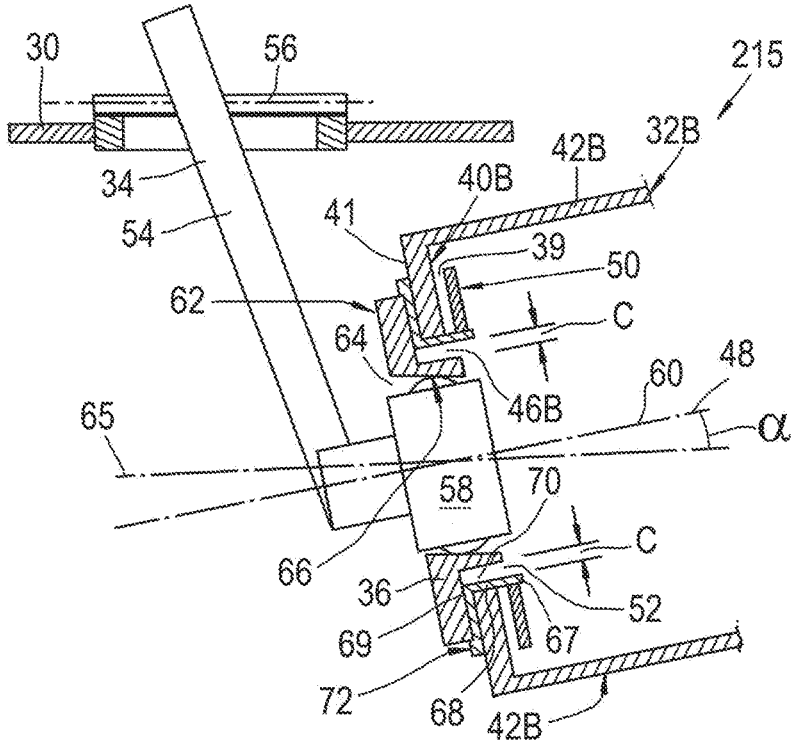
FIG. 4 is an enlarged alternative schematic cross-sectional view of the combustion chamber assembly shown in FIG. 1.

An alternative combustion chamber assembly 215 is shown in FIG. 4. The combustion chamber assembly 215 is substantially the same as the combustion chamber assembly 15 shown in FIG. 2 and like parts are denoted by like numerals. However, the combustion chamber assembly 215 differs from that in FIG. 2 in that the combustion chamber assembly 215 comprises a plurality of tubular combustion chambers 32B rather than an annular combustion chamber. Each tubular combustion chamber 32B comprises an upstream end wall 40B and a single annular, tubular, wall 42B. The upstream end of the annular wall 42B is secured to the upstream end wall 40B. The upstream end wall 40B of each tubular combustion chamber 32B has a single aperture 46B extending there-through. The aperture 46B extends perpendicularly through the upstream end wall 40B of the tubular combustion chamber 32B. The tubular combustion chambers 32B and the centre lines 48 of the combustion chambers 32B are arranged at an acute angle α to the axis of the annular combustion chamber casing 30 and the axis X of the turbofan gas turbine engine 10.

As a further alternative the tubular combustion chambers of FIG. 4 may have a similar arrangement of tubular seals, location rings, spherical surfaces of the fuel injector heads, apertures in the upstream end walls and heat shields to that shown in FIG. 3.

As a further alternative the annular combustion chamber of FIG. 2 may have a part spherical surface 66 of each fuel injector head 58 which comprises an ellipse arranged in a plane at an angle to the axis 60 of the fuel injector head 58. The arrangement of the spherical surface 66 of each fuel injector head 58 in FIG. 2 ensures that the contact points between the spherical surface 66 and the internal surface of the tubular seal 36 are axially within the tubular seal 36 at all extremes of tolerance and for all relative axial movements between the fuel injector head 58 and the tubular seal 36. It is to be noted that the angle is generally parallel to the angle of the frustoconical upstream end wall 40.

Figure 5:
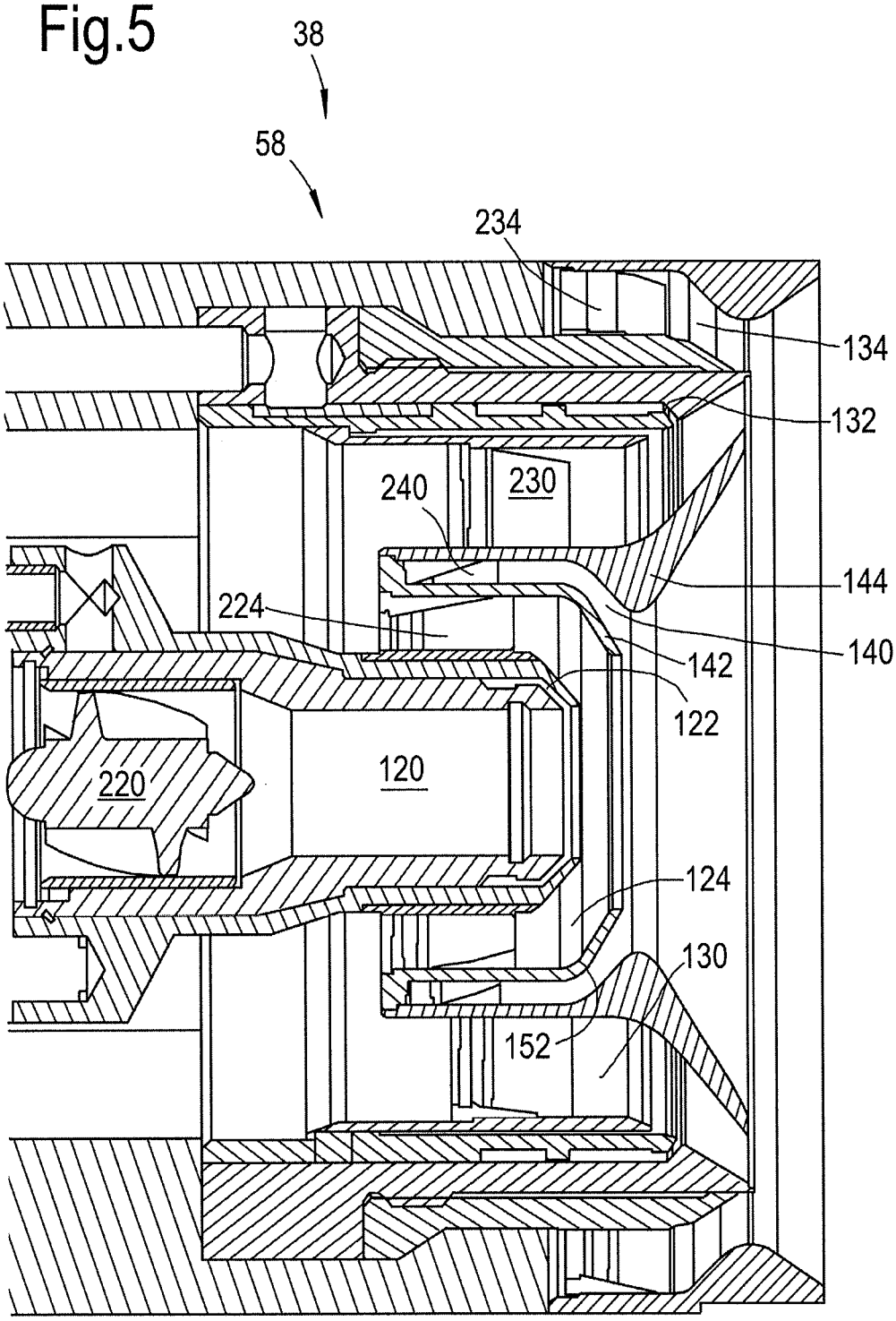
FIG. 5 is an enlarged cross-sectional view of a fuel injector head of a fuel injector shown in FIGS. 2, 3 and 4.

A fuel injector head 58 of one of the fuel injectors 38 used in FIGS. 2 to 4 is shown in FIG. 5. The fuel injector 38 is a lean burn fuel injector. The fuel injector head 58 has a coaxial arrangement of an inner pilot airblast fuel injector and an outer mains airblast fuel injector. The pilot airblast fuel injector comprises, in order from radially inner to outer, a coaxial arrangement of a pilot inner air swirler passage 120, an annular pilot fuel passage 122 and an annular pilot outer air swirler passage 124. The mains airblast fuel injector comprises, in order from radially inner to outer, a coaxial arrangement of an annular mains inner air swirler passage 130, an annular mains fuel passage 132 and an annular mains outer air swirler passage 134. An intermediate annular air swirler passage 140 is sandwiched between the annular pilot outer air swirler passage 124 of the pilot airblast fuel injector and the annular mains inner air swirler passage 130 of the mains airblast fuel injector. An annular first splitter wall 142 separates the annular pilot outer air swirler passage 124 from the intermediate annular air passage 140 and an annular second splitter wall 144 separates the intermediate air swirler passage 140 from the annular mains inner air swirler passage 130. Each air swirler passage 120, 124, 130, 134 and 140 has a respective swirler 220, 224, 230, 234 and 240 which swirls the air flow through that passage. Each swirler comprises a plurality of swirl vanes. The fuel from the annular pilot fuel passage 122 of the inner pilot airblast fuel injector flows onto a downstream pre-filming surface to be atomised by the air flows from the pilot inner air swirler passage 120 and the annular pilot outer air swirler passage 124. The fuel from the annular mains fuel passage 132 of the outer mains airblast fuel injector flows onto a downstream conical pre-filming surface to be atomised by the air flows from the annular mains inner air swirler passage 130 and the annular mains outer air swirler passage 134.

The flange of the fuel injector may not be arranged at a perpendicular angle to the fuel feed arm and the fuel feed arm being arranged at a perpendicular angle to the axis of the fuel injector head. The flange of the fuel injector may not be arranged at a perpendicular angle to the fuel feed arm and the fuel feed arm not being arranged at a perpendicular angle to the axis of the fuel injector head. The flange of the fuel injector may be arranged at a perpendicular angle to the fuel feed arm and the fuel feed arm not being arranged at a perpendicular angle to the axis of the fuel injector head.

The advantage of the present disclosure is that it provides a clearance required to engage, or disengage, a fuel injector which has a fuel injector head which is relatively axially long, or a fuel injector which has a fuel injector head which is relatively axially long and has a relatively large external diameter, whilst minimising the amount of material removed from the upstream end wall of the combustion chamber between the apertures in the upstream end wall. The present disclosure is therefore particularly applicable to a lean burn fuel injector. A further advantage of the present discourse is that it eliminates the need to provide additional clearance for the tubular seal to move radially to facilitate installation and extraction of a fuel injector, especially when the flange of the fuel injector is not parallel with the axis of the fuel injector head. Additional advantages of the present disclosure is that it ensures that the amount of material, e.g. metal, between the apertures in the upstream end wall and the amount of material, e.g. metal, between the radially extending walls and the apertures in the heat shields is maximised to maximise the strength of the upstream end wall and to maximise the strength of the heat shields and this also maximises the amount of space to provide impingement cooling holes in the upstream end wall and effusion cooling holes in the heat shields and hence maximise the time between services. An additional advantage of the present disclosure is that it allows the combustion chamber assembly to be built if the fuel injectors are internally mounted to the annular combustion chamber casing, especially if the fuel injectors are lean burn fuel injectors and if the flange of the fuel injector is not parallel with the axis of the fuel injector head. Note that the flange of an internally mounted fuel injector is provided on the inner surface of the annular combustion chamber casing whereas the flange of an internally mounted fuel injector is provided on the outer surface of the annular combustion chamber casing.

Although, the annular combustion chamber casing has plurality of apertures extending there-through, the combustion chamber is an annular combustion chamber, there are a plurality of fuel injectors and a plurality of tubular seals, the upstream end wall having a plurality of apertures extending there-through, the flange of each fuel injector being secured to the annular combustion chamber casing, the fuel injector head of each fuel injector being located in a respective one of the apertures in the upstream end wall, each tubular seal being positioned between one of the fuel injector heads and the respective aperture in the upstream end wall, the aperture through each tubular seal being arranged parallel to the axis of the annular combustion chamber casing, each fuel injector head being located in the respective tubular seal, each fuel injector head having a part spherical surface and the part spherical surface of each fuel injector head abutting the respective tubular seal.

Although the present disclosure has referred to the use of separate heat shields and flanged tubular location rings, it may be possible to provide each of the heat shields with a coaxial tube which is integral, e.g. the heat shield and the tube are monolithic or a single piece, and a separate locating disc. The tube of the each heat shield is arranged to extend through and locate in the respective aperture in the upstream end wall and each locating disc is provided at the other side of the upstream end wall. Similarly, it may be possible to provide each of the heat shields with a coaxial tube which is integral, e.g. the heat shield and the tube are monolithic or a single piece, and not have a separate locating disc. The tube of the each heat shield is arranged to extend through and locate in the respective aperture in the upstream end wall.

Although the present disclosure has referred to the use of heat shields in which each heat shield has a central aperture it may be possible to provide heat shields which are arranged such that adjacent heat shields together define an aperture as in our published patent application GB2524265A. Although the present disclosure has referred to the use of heat shields, it may be possible that the upstream end wall is not provided with heat shields.

Although the present disclosure has been described with reference to a lean burn fuel injector it may be equally applicable to a rich burn fuel injector, especially if the fuel injector head of the rich burn fuel injector is relatively axial long. The rich burn fuel injector may comprise a first inner air passage, a first annular fuel passage, a second annular air passage and a third annular air passage. The rich burn fuel injector may comprise a first inner air passage, a second annular air passage, a first annular fuel passage and a third annular air passage. Each of the air passages may comprise a plurality of swirl vanes. The annular fuel passage may direct the fuel onto a pre-filming surface.

Although the present disclosure has referred to a combustion chamber assembly comprising an annular combustion chamber it is equally applicable to a combustion chamber assembly comprising at least one tubular combustion chamber, e.g. a plurality of tubular combustion chambers arranged in a canannular arrangement.

Although though the present disclosure has referred to a turbofan gas turbine engine it is equally applicable to a turbojet gas turbine engine, a turbo-propeller gas turbine engine and a turbo-shaft gas turbine engine. Although the present invention has referred to an aero gas turbine engine it is equally applicable to a marine gas turbine engine, an automotive gas turbine engine and an industrial gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber assembly for a gas turbine engine, the combustion chamber assembly comprising an annular combustion chamber casing, at least one combustion chamber, at least one fuel injector and at least one tubular seal, the combustion chamber casing having an axis, coincident to an axis of the gas turbine engine, and at least one aperture extending there-through, the combustion chamber having a centre line, the combustion chamber comprising an upstream end wall having at least one aperture extending there-through, the centre line of the combustion chamber being arranged at an angle to the axis of the annular combustion chamber casing, the at least one fuel injector comprising a fuel feed arm, a flange and a fuel injector head, the at least one fuel injector locating in the at least one aperture in the annular combustion chamber casing, the flange of the at least one fuel injector being secured to the annular combustion chamber casing, the fuel injector head of the at least one fuel injector being located in the at least one aperture in the upstream end wall, the fuel injector head having an axis and a plurality of annular passages, the axis of the fuel injector head being arranged at an angle to the axis of the annular combustion chamber casing and/or at an angle to the flange of the fuel injector and parallel to the centre line of the at least one combustion chamber, the at least one tubular seal being positioned between the fuel injector head and the at least one aperture in the upstream end wall, the at least one tubular seal having a flange, an aperture extending through the at least one tubular seal and the axis of the aperture being arranged parallel to the axis of the annular combustion chamber casing and/or parallel to the flange of the fuel injector, the at least one tubular seal being movable radially and circumferentially with respect to the axis of the annular combustion chamber casing, and the fuel injector head being located in the at least one tubular seal, the fuel injector head having a part spherical surface and the part spherical surface of the fuel injector head abutting the at least one tubular seal.

2. The combustion chamber assembly as claimed in claim 1, wherein the at least one combustion chamber comprising at least one heat shield, the at least one heat shield being adjacent to and spaced from a first surface of the upstream end wall of the at least one combustion chamber, the at least one heat shield having an aperture extending there-through, the aperture in the at least one heat shield being arranged coaxial with the at least one aperture in the upstream end wall of the combustion chamber.

3. The combustion chamber assembly as claimed in claim 2, wherein the at least one combustion chamber comprising at least one tubular location ring, the at least one tubular location ring being arranged between the at least one tubular seal and the at least one aperture in the upstream end wall, the at least one tubular location ring having an aperture extending there-through, the aperture in the at least one tubular location ring being arranged coaxial with the at least one aperture in the upstream end wall of the combustion chamber.

4. The combustion chamber assembly as claimed in claim 3, wherein the at least one tubular location ring being positioned in and extending through the at least one aperture in the upstream end wall of the at least one combustion chamber, a first end of the at least one tubular location ring locating in the aperture in the at least one heat shield to secure the at least one heat shield on the upstream end wall of the at least one combustion chamber.

5. The combustion chamber assembly as claimed in claim 4, wherein a second end of the at least one tubular location ring having a flange arranged to abut a second surface of the upstream end wall of the combustion chamber.

6. The combustion chamber assembly as claimed in claim 1, wherein the axis of the at least one aperture in the upstream end wall of the combustion chamber being arranged parallel to the centre line of the at least one combustion chamber.

7. The combustion chamber assembly as claimed in claim 6, wherein the axis of the aperture through the tubular seal being arranged at an angle to the axis of the tubular seal, the axis of the tubular seal being arranged parallel to the centre line of the at least one combustion chamber and the flange of the tubular seal being arranged perpendicular to the axis of the tubular seal.

8. The combustion chamber assembly as claimed in claim 1, wherein the axis of the at least one aperture in the upstream end wall of the combustion chamber being arranged parallel to the axis of the annular combustion chamber casing and/or parallel to the flange of the fuel injector.

9. The combustion chamber assembly as claimed in claim 8, wherein the axis of the aperture through the tubular seal being arranged coaxial with the axis of the tubular seal, the axis of the tubular seal being arranged parallel to the axis of the annular combustion chamber casing and/or parallel to the flange of the fuel injector, the flange of the tubular seal being arranged at an angle to the axis of the tubular seal.

10. The combustion chamber assembly as claimed in claim 1, wherein the combustion chamber casing having plurality of apertures extending there-through, the at least one combustion chamber comprising an annular combustion chamber, a plurality of fuel injectors and a plurality of tubular seals, the upstream end wall having a plurality of apertures extending there-through, the flange of each fuel injector being secured to the annular combustion chamber casing, the fuel injector head of each fuel injector being located in a respective one of the apertures in the upstream end wall, each tubular seal being positioned between one of the fuel injector heads and the respective aperture in the upstream end wall, the aperture through each tubular seal being arranged parallel to the axis of the annular combustion chamber casing and/or parallel to the flange of the fuel injector, each fuel injector head being located in the respective tubular seal, each fuel injector head having a part spherical surface and the part spherical surface of each fuel injector head abutting the respective tubular seal.

11. The combustion chamber assembly as claimed in claim 1, wherein the at least one fuel injector comprising a lean burn fuel injector.

12. The combustion chamber assembly as claimed in claim 11, wherein the at least one lean burn fuel injector comprising a first inner air passage, a first annular fuel passage, a second annular air passage, a third annular air passage, second annular fuel passage and a fourth annular air passage.

13. The combustion chamber assembly as claimed in claim 12, wherein the at least one lean burn fuel injector comprising a fifth annular air passage between the second annular air passage and the third annular air passage.

14. The combustion chamber assembly as claimed in claim 12, wherein each of the air passages comprising a plurality of swirl vanes.

15. The combustion chamber assembly as claimed in claim 12, wherein each of the annular fuel passages directing the fuel onto a pre-filming surface.

16. The combustion chamber assembly as claimed in claim 1, wherein the part spherical surface of the fuel injector head comprises an ellipse arranged in a plane at an angle to the axis of the fuel injector head.

17. The combustion chamber assembly as claimed in claim 1, wherein the contact points between the part spherical surface of the fuel injector head and the tubular seal are arranged axis-symmetrically with respect to the fuel injector head.

18. The combustion chamber assembly as claimed in claim 1, wherein the contact points between the part spherical surface of the fuel injector head and the tubular seal are arranged helically, or part helically, with respect to the axis of the fuel injector head.

19. The combustion chamber assembly as claimed in claim 1, wherein the at least one combustion chamber comprising at least one tubular location ring, the at least one tubular location ring being arranged between the at least one tubular seal and the at least one aperture in the upstream end wall, the at least one tubular location ring having an aperture extending there-through, the aperture in the at least one tubular location ring being arranged coaxial with the at least one aperture in the upstream end wall of the combustion chamber.

20. A gas turbine engine comprising the combustion chamber assembly as claimed in claim 1.

* * * * *